United States Patent [19]

Walker

[11] Patent Number: 4,776,477

[45] Date of Patent: Oct. 11, 1988

[54] KNOCK-DOWN BIN

[75] Inventor: Dale Walker, Streator, Ill.

[73] Assignee: Knoedler Manufactures, Inc., Streator, Ill.

[21] Appl. No.: 40,206

[22] Filed: Apr. 16, 1987

[51] Int. Cl.[4] ..... B65D 6/00

[52] U.S. Cl. ..... 220/4 F; 220/22; 220/22.3; 220/76; 220/77; 206/561; 229/120.06

[58] Field of Search ..... 229/120.02, 120.06, 229/120.09, 120.24, 120.25, 41 B; 206/45.11, 577, 557, 558, 561; 220/4 R, 4 F, 20, 22, 22.1, 22.2, 22.3, 22.5, 67, 75, 76, 77

[56] References Cited

U.S. PATENT DOCUMENTS

| | | | |
|---|---|---|---|
| 1,995,335 | 3/1935 | Wilke | 220/22 |
| 2,140,879 | 12/1938 | O'Neal | 220/22 |
| 2,182,201 | 12/1939 | Harris | 220/75 |
| 3,827,570 | 8/1974 | Betts | 206/561 |
| 4,067,630 | 1/1978 | Stark et al. | 220/22.3 |

FOREIGN PATENT DOCUMENTS

| | | | |
|---|---|---|---|
| 83105 | 5/1964 | France | 220/4 F |
| 2003338 | 11/1969 | France | 220/4 F |

*Primary Examiner*—Willis Little

*Attorney, Agent, or Firm*—Robert E. Browne

[57] ABSTRACT

A collapsible bin includes a bottom (12) having an integral peripheral flange (24), a rear panel (16) and a pair of side panels (14). The rear panel has C-shaped channels (44) on opposite ends and integral offsets (46) along lower edges while the side panels have C-shaped channels (42) on rear edges and offsets (32) along lower edges so that the panels can be interconnected by telescoping the channels into each other and connected to the bottom by the offsets being telescoped onto the free edge of the flange.

11 Claims, 2 Drawing Sheets

FIG. 1
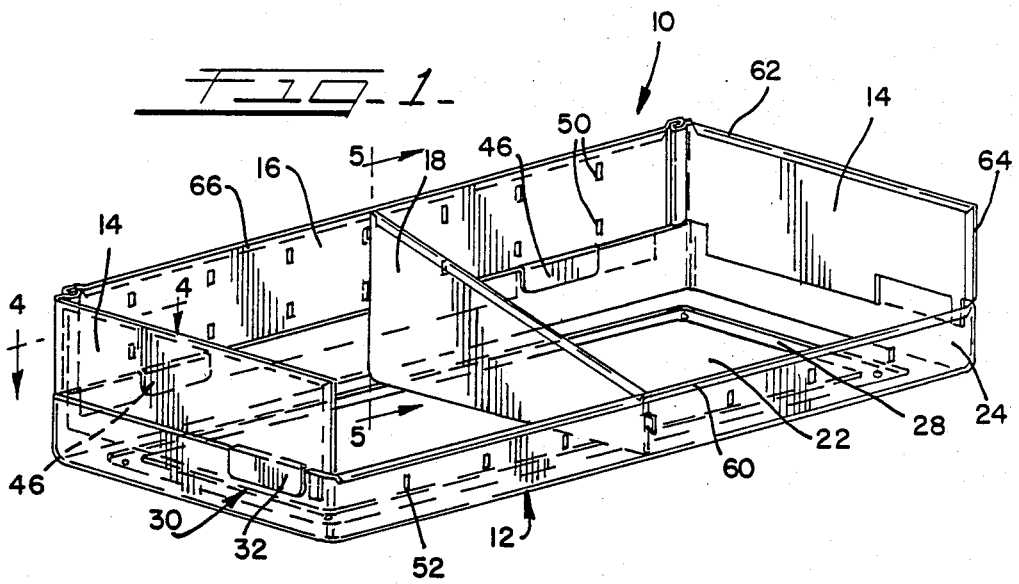
FIG. 2
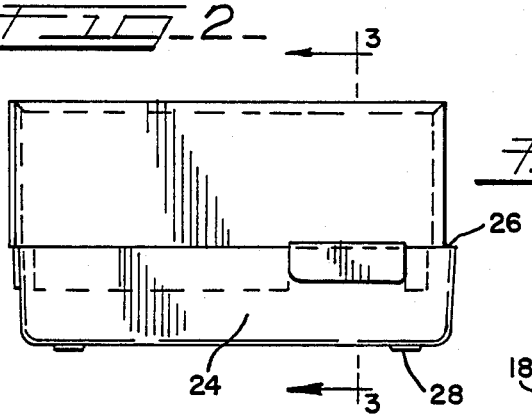
FIG. 3
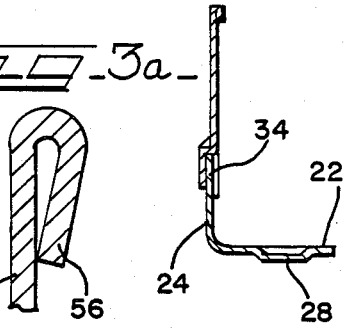
FIG. 3a
FIG. 4
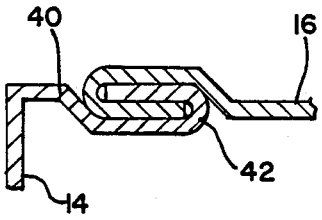
FIG. 5
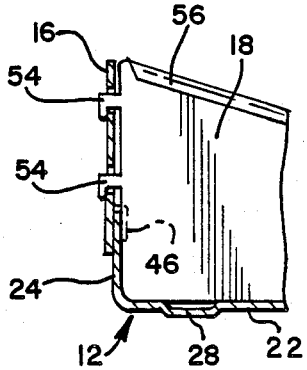

KNOCK-DOWN BIN

DESCRIPTION

TECHNICAL FIELD

The present invention relates generally to storage devices and, more particularly, to a bin having a construction allowing it to be shipped in a flattened or knock-down condition and later quickly assembled without the use of any fasteners or tools.

BACKGROUND PRIOR ART

Storage bins have been used for decades in a number of different environments. For example, open-top bins are usually used in warehouses for storing various elements so that they are readily accessible when needed.

Usually these bins are formed from a sheet metal material and the parts thereof are either welded, riveted or bolted together. In the case of storage units made of strong, thin material, such as steel, spot-welding is the most favored method of holding the elements together. Since spot-welding requires rather special equipment and expertise, such assembly is done at the factory, which precludes shipping the bins in a collapsed condition. Thus, the size and bulk of the assembled bins necessitates large containers and wasted shipping space, since the inside volume of the container is wasted space. Also, in certain environments, particularly when dealing with the military, all components that are provided must have certain minimum strength characteristics in response to stresses and tension.

Normally such storage units also must be free of protrusions and projections on the inner surfaces, which precludes using bolt and nuts fasteners since the bolt and/or nut must usually protrude from the inner or outer surface.

Thus, there remains a need for a collapsible bin construction that has sufficient rigidity when in use, but can still be assembled without any special tools or fasteners.

SUMMARY OF THE INVENTION

According to the present invention, a storage bin is formed with the usual bottom and sides, which have novel means for attachment to one another to provide a bin that is capable of being knocked down and shipped in a flattened condition and later assembled without any special tools to thereby overcome the wasted space incurred in shipping pre-assembled units. The bin can easily and quickly be assembled merely by manipulation of the various components or elements and at the same time has extremely rigid joints, particularly at the corner connections for the components.

More specifically, the knock-down bin of the present invention includes an integral bottom wall that has a peripheral, upwardly-directed flange having an upper exposed edge. A pair of substantially identical side walls each have at least one locking tab formed by a cut-out that is deformed to one side of the main body and offset to define a downwardly-opening slot which receives the exposed edge of the bottom wall. Each of the side walls also has a channel-shaped interlocking element at one end which interlocks with a corresponding channel on opposite ends of the rear wall. The corresponding channels can be interlocked by telescoping movement and provide a rigid joint at the corners of the bin. The rear wall also has offset portion that define downwardly-opening slots that receive the upper free edge of the flange.

In the assembled condition, all of the exposed edges of the bin have the free edges thereof bent upon themselves to form teardrop-shaped reinforcing edges which also eliminates any sharp edges in the assembled bin.

The bin may also have one or more divider panels that have locking tabs at opposite ends thereof which are received into retention slots that are defined in the rear wall as well as in the portion of the flange that defines the front wall.

According to another aspect of the invention, the bottom wall or base has the upwardly-directed flange tapered outwardly by a small degree so that the bottom walls or panels may be nested for shipment to further reduce the space requirements during transportation. The rear panel and the side panels are dimensioned to fit into the bottom for transportation.

The bottom panel or wall also preferably has the reinforcing rib or track integrally deformed from the main body and extending downwardly below the main body. The rib or track may also have drain holes formed therein for the drainage of any liquid that may accumulate in the integral bottom wall.

BRIEF DESCRIPTION OF DRAWINGS

FIG. 1 is a perspective view of the collapsible bin constructed in accordance with the teachings of the present invention;

FIG. 2 is a side elevation view of the bin shown in FIG. 1;

FIG. 3 is a cross-sectional view, as viewed along line 3—3 of FIG. 2;

FIG. 3*a* is a fragmentary cross-sectional view of the reinforced edges of the bin;

FIG. 4 is a fragmentary cross-sectional sectional view, as viewed along line 4—4 of FIG. 1;

FIG. 5 is a fragmentary cross-sectional sectional view, as viewed along line 5—5 of FIG. 1; and, FIG. 6 is an exploded perspective view of the components forming the bin shown in FIG. 1.

DETAILED DESCRIPTION

Figure 6:
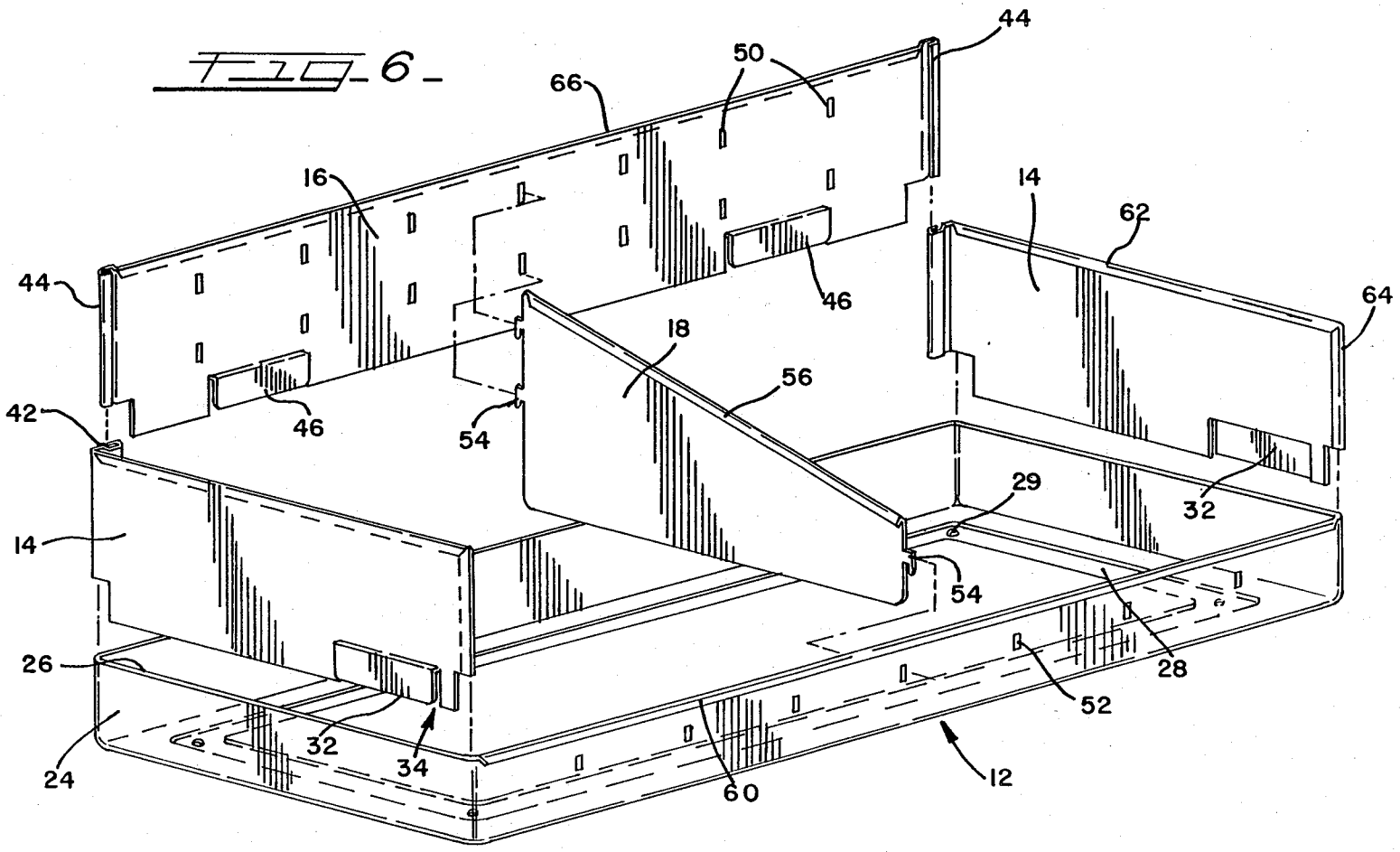

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to embodiment illustrated.

FIG. 1 of the drawings discloses the collapsible bin, generally designated by reference numeral 10, and constructed in accordance with the present invention. The bin 10 includes a bottom wall or panel 12, a pair of substantially identical side walls 14 and a rear wall 16, as well as one or more divider panels 18, to be described later. All of the components are preferably formed of sheet metal so that they can be easily fabricated.

The bottom 12 is preferably a one-piece drawn pan that has a generally flat bottom wall 22 with an upwardly-directed flange 24 extending from the periphery thereof and terminating in a generally flat upper edge 26. The flange 24 is preferably tapered outwardly by a small acute angle, such as about 3°, so that a plurality of pans can be nested into each other for transportation and shipment. The bottom wall 22 also has a reinforcement rib or channel 28 deformed from the main body to define a generally rectangular track that reinforces the bottom 22. The rectangular reinforcement rib or track 28 in the bottom wall or floor of the pan provides strength for the pan and also provides a positioning rib to grip the rack means which normally support the bins in a warehouse. The bottom 12 may also have drain holes 29, preferably formed in the track 28. Thus, the reinforcing rib or track may be considered to be a positioning element for the bin when the bin is being placed into service and also defines a lower support surface when the bin is placed on a flat surface.

Each of the side panels 14 is substantially identical in configuration and include at least one locking tab 30 formed on the lower edge thereof. The locking tab is formed by cutting out a selected segment of the main body and offsetting the selected segment to one side of the main body to form a downwardly-opening slot 34.

Each side panel also has a reinforcement and connecting channel formed at the rear edge thereof. As shown in FIG. 4, the side panel or wall 14 has an inwardly-directed extension 40 which terminates at its outer free edge in a generally C-shaped channel 42 that is open at opposite ends.

The rear panel or wall 16 also has a corresponding C-shaped channel 44 at opposite ends thereof and the channels 44 are adapted to be telescoped into the channels 42 to provide a rigid joint at the juncture between the side walls 14 and the rear wall 16. The rear wall 16 also has locking tabs in the form of one or more offsets 46 that define downwardly-opening slots for receiving the upwardly-extending flange 24 of the bottom wall.

Thus, the side panels and rear panel can easily be assembled merely by telescoping or by manipulation of the components to an assembled condition, shown in FIG. 1, wherein the telescoping channels 42 and 44 provide a rigid joints at the rear corners of the bin and the locking tabs 30 and 46 secure the panels to the bottom 12.

According to a further aspect of the invention, the bin may have one or more divider panels 18 associated therewith to divide the bin into separate compartments. For this purpose, the rear panel or wall has a plurality of sets of retention slots 50 formed therein at transversely-spaced locations. Also, the portion of the upwardly-directed flange 24 defines the front wall and has transversely-spaced slots 52. The divider panel 18 has generally L-shaped hooks 54 (FIG. 5) integrally formed at opposite ends thereof and the hooks are adapted to be manipulated into the retention slots 50, 52 to secure the divider panel in position within the bin. Preferably, the divider panels have upper edges 56 bent to an overlapping position to produce a teardrop-shaped reinforcement element along the upper edge. Also, the upper edge tapers downwardly toward the front wall, as shown in FIG. 1.

It should be noted that the rear panel and front panel have a plurality of sets of aligned retention slots 50, 52 which are preferably spaced at six-inch increments so that one or more divider panels can be positioned where desired.

Preferably, all of the exposed edges of the assembled unit are reversibly bent to provide reinforcement and to produce a smooth finished edge. Thus, the upper edge 60 of the front wall defined by flange 24 is bent to a teardrop configuration. Also, the top and front edges 62, 64 of side panels 14 and the top edge 66 of rear panel 16 are reversibly bent to the configuration shown in FIG. 3*a*.

While the specific embodiments have been illustrated and described, numerous modifications come to mind without significantly departing from the spirit of the invention and the scope of protection is only limited by the scope of the accompanying claims.

I claim:

1. A knock-down bin comprising an integral bottom wall having an upwardly-directed flange around the periphery thereof defining an upper free edge, a pair of side walls and a rear wall, each side wall having a lower edge with an offset adjacent a front end defining a downwardly-opening slot received over said upper free edge, each side wall having a vertically generally C-shaped channel along a rear end within said C-shaped channel being open at its upper end, said rear wall having a corresponding channel on each end with said corresponding channels being telescoped into respective channels of respective side walls to define corner connections, said rear wall having at least one cut-out portion adjacent a lower edge that is offset from a main body thereof to define a slot receiving said upper free edge of said bottom wall so that said side walls and said rear wall can be assembled by manipulation thereof and said channels define reinforced corners for said bin.

2. A knock-down bin as defined in claim 1, in which said offsets on said side walls extend from an outer surface thereof.

3. A knock-down bin as defined in claim 1, in which said upwardly-directed flange defines a front exposed edge for said bin and in which said exposed edge is bent to an overlapping position to reinforce said edge.

4. A knock-down bin as defined in claim 3, in which said exposed edge is bent to a teardrop shape in cross-section.

5. A knock-down bin as defined in claim 1, in which said upwardly-directed flange is tapered outwardly to define a small acute angle with respect to a vertical plane.

6. A knock-down bin as defined in claim 1, in which said bottom wall has a reinforcement channel deformed from the main body.

7. A knock-down bin as defined in claim 1, further including a divider panel having hooks at opposite ends with said rear wall having at least one retention slot receiving a hook on one end and said flange defining a front wall having at least one retention slot receiving a hook on an opposite end of said divider panel.

8. A collapsible bin comprising a generally rectangular base having an upwardly-directed flange extending from the periphery thereof and defining an exposed edge, a pair of substantially identical side panels each having a generally C-shaped channel member on a rear edge thereof and an offset portion adjacent a lower edge defining a downwardly-opening slot receiving said exposed edge, and a rear panel having a generally C-shaped channel at each end and adapted to be telescoped into said C-shaped channels on the respective side panels to connect the rear panel to said side panels, said rear panel having at least one offset portion defining a downwardly-opening slot receiving said exposed edge to connect said rear panel to said base.

9. A collapsible bin comprising a generally rectangular metal bottom having an integral upwardly-directed flange extending from a peripheral edge and having an integral generally rectangular reinforcement channel deformed downwardly and spaced inwardly of said peripheral edge to provide a support surface for said bottom, a generally rectangular rear panel and a pair of rectangular side panels, said rear panel having slot means defined on a lower edge receiving said flange and having C-shaped channels at opposite ends, each of said side panels having slot means on a lower edge and an integral extension extending inwardly from a rear edge and having a corresponding C-shaped channel so that said side panels and said rear panel can be interconnected by telescoping said channels into each other and said panels are connected to said bottom by manipulating said panels to position said flange into said slot means, said panels having exposed edges reversibly bent to provide smooth reinforced edges, said flange defining a front wall for said bin and having an upper edge reversibly bent to a smooth reinforced edge.

10. A collapsible bin as defined in claim 9, in which said upwardly-directed flange is tapered outwardly about 3 with respect to a vertical plane so that a plurality of bottoms can be nested for shipment and said side and rear panels can be stored in said bottoms for shipment to minimize space requirements for transportation.

11. A collapsible bin as defined in claim 9, in which said rear panel and front panel have retention slots defined therein, and further including a divider panel having integral hook means on opposite ends received into said retention slots.

* * * * *